United States Patent [19]

Nulman

[11] 4,254,683

[45] Mar. 10, 1981

[54] STRINGED ELECTRICAL INSTRUMENT

[76] Inventor: David Nulman, 1330 E. 27th St., Brooklyn, N.Y. 11210

[21] Appl. No.: 967,685

[22] Filed: Dec. 8, 1978

[51] Int. Cl.[3] ..... G10H 3/00

[52] U.S. Cl. ..... 84/1.16; 84/1.15; 84/DIG. 3

[58] Field of Search ..... 84/1.16, 1.14, DIG. 3, 84/1.15

[56] References Cited

U.S. PATENT DOCUMENTS

| | | | |
|---|---|---|---|
| 2,561,551 | 7/1951 | Allen | 84/1.16 |
| 3,538,807 | 11/1970 | Francis | 84/1.16 |
| 3,544,696 | 12/1970 | Andrew | 84/1.16 |
| 4,142,435 | 3/1979 | Pozar | 84/1.16 |

*Primary Examiner*—Gene Z. Rubinson
*Assistant Examiner*—Forester W. Isen
*Attorney, Agent, or Firm*—Bernard Malina

[57] ABSTRACT

An electric stringed musical instrument is formed of a body section adapted to detachably receive an interchangeable neck section. The body section mounts the electronic tone and volume controls and includes the electromagnetic pickup which is rendered into operative proximity to the neck strings when the instrument is in the assembled condition. The body section is adapted to interchangeably receive neck sections of various string types and fingerboard widths and the electromagnetic pickup is selectively moveable in the longitudinal, i.e., horizontal direction and also in the vertical direction to accomodate the particular string characteristics of the interchangeable neck section.

8 Claims, 8 Drawing Figures

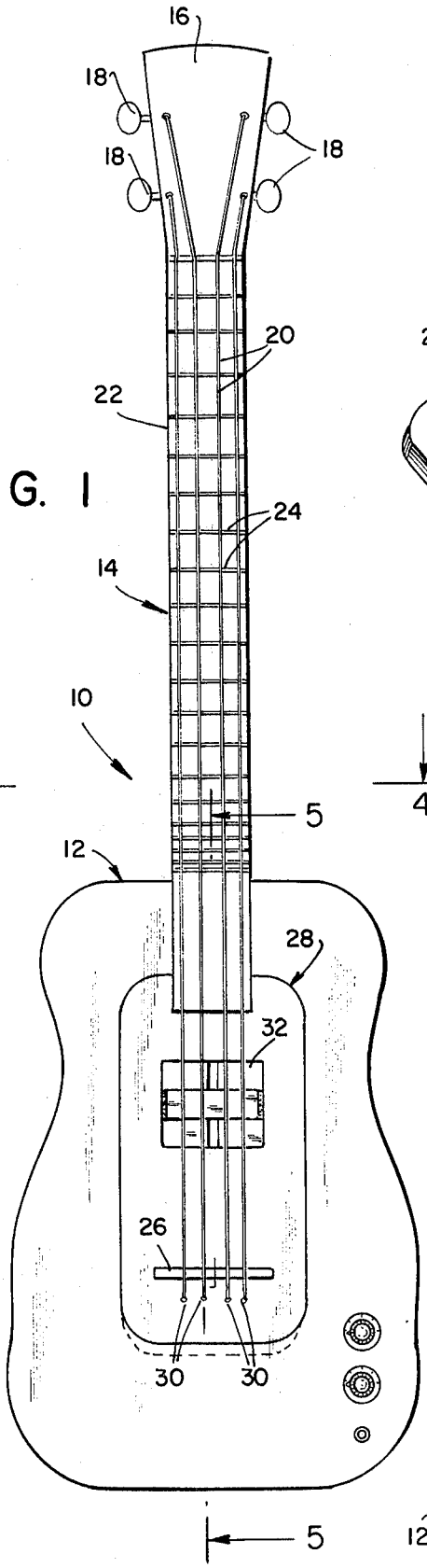
FIG. 1
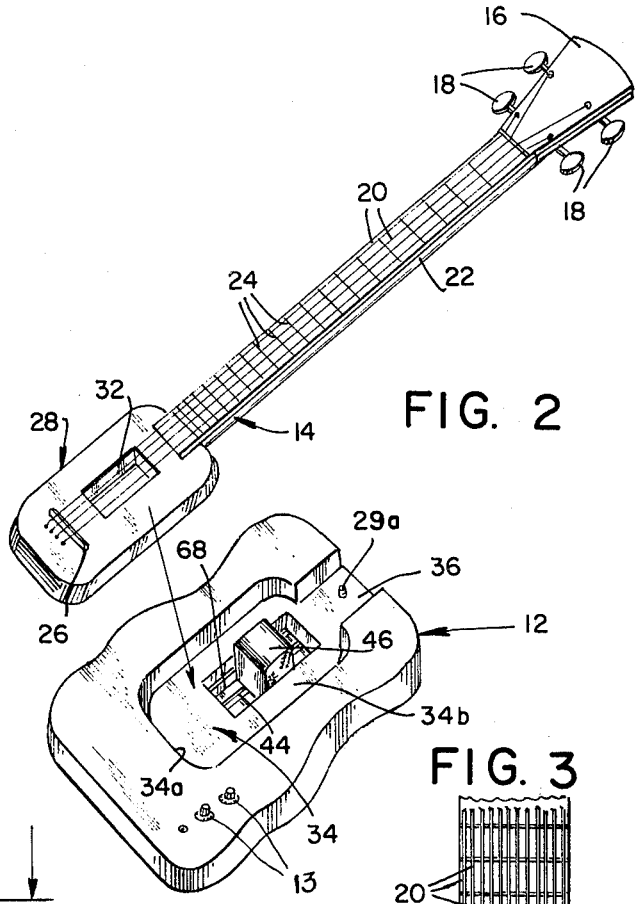
FIG. 2
FIG. 3
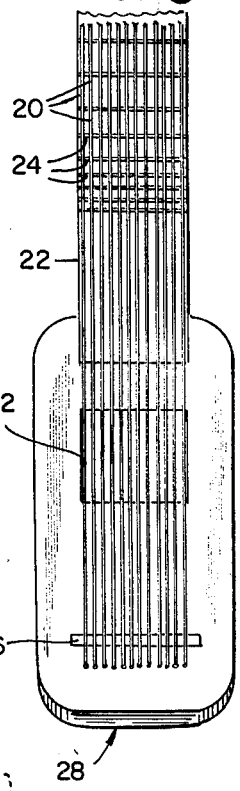
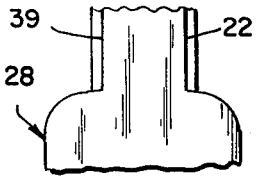
FIG. 3A
FIG. 4
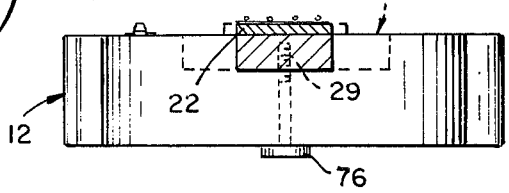

FIG. 5
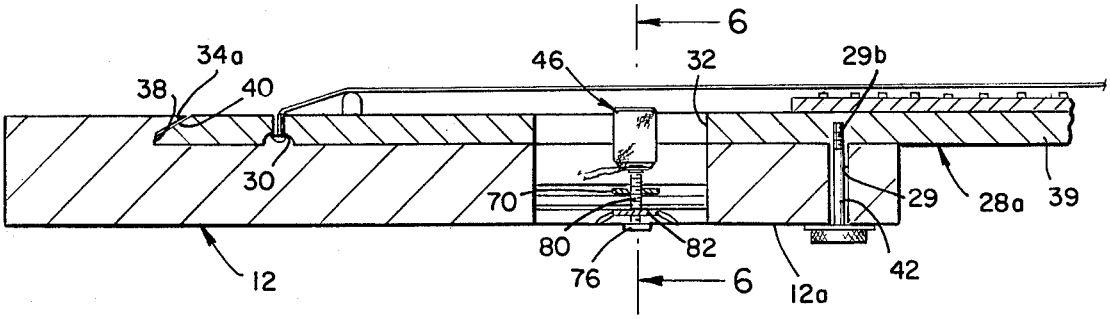
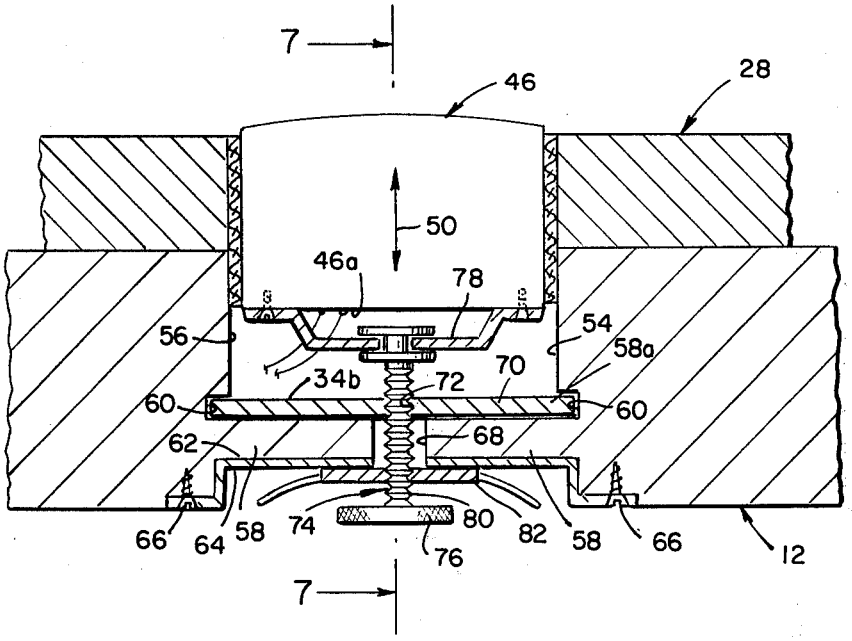
FIG. 6
FIG. 7
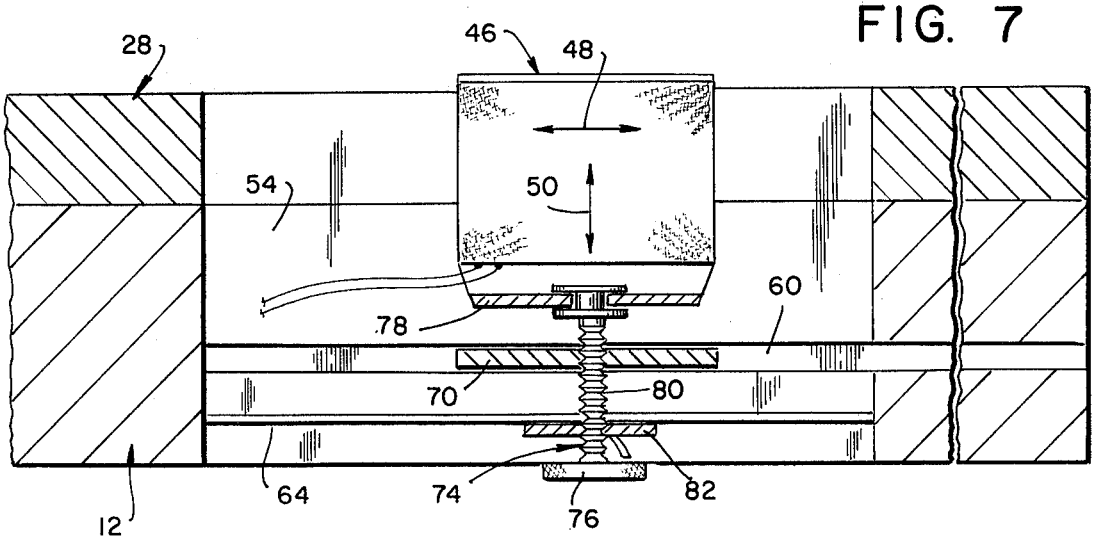

STRINGED ELECTRICAL INSTRUMENT

BACKGROUND OF THE INVENTION

The present invention relates to stringed musical instruments and more particularly to a stringed musical instrument having releasably assembled components.

Generally speaking, the musical style of a solid body electric guitar is, in part, determined by the number of strings, string configuration of the neckpiece as well as width of the fingerboard and fret spacing. Guitarists, particularly professionals, find it necessary to have at least several guitars of different musical styles for concert purposes. However, since fine electric guitars are relatively expensive, musicians are compelled to expend considerable sums of money for the purchase of an array of electric guitars covering the desired range of musical styles. As a result, such musicians are burdened with the necessity of transporting the array of electric guitars to and from each performance.

Although the functional design of the neckpiece varies in accordance with the desired musical style of the instrument, the body section which mounts the electronic controls may remain basically standard in design for instruments of varying musical style. The instrument body section mounting the electronic controls and magnetic pickup accounts for a major portion of the total instrument weight as well as instrument cost.

It is therefore an object of the present invention to provide an electric stringed instrument formed of body and neck sections which are readily assembled to form a unitary instrument and disassembled without the requirement of any tools.

It is another object of the present invention to provide an electric stringed instrument of the character described wherein said body section is adapted to interchangeably mount any one of a plurality of neck sections of different string configurations.

It is yet another object of the present invention to provide an electric stringed instrument of the character described wherein said body section has the magnetic pickup and electric volume and tone controls permanently mounted thereon.

SUMMARY OF THE INVENTION

In accordance with the principles of the present invention there is provided an electric stringed musical instrument comprising a neck section which includes a neck portion having an integrally connected head member at one end and an integrally connected base portion at the other end. A plurality of strings are mounted at one end on the head member and extend longitudinally across the length of the neck portion. The other ends of the strings are secured to the base portion at its end remote from the neck portion. The instrument further includes a body section having a recessed socket adapted to receive the base portion of the neck section, and electronical pickup means mounted in the body section socket in operative proximity with the neck strings when the neck section base portion is seated in the body section socket. There is further provided attachment means for fixedly securing the neck section to the body section when the neck base portion is seated in the body section socket to form the instrument in unitary form.

Further objects, features and advantages of this invention will become apparent from a consideration of the following description, the appended claims and the accompany-drawings in which:

BRIEF DESCRIPTION OF THE DRAWINGS

FIG. 1 is a plan view of a stringed electrical musical instrument in accordance with the principles of the present invention in one embodiment thereof;

FIG. 2 is an exploded perspective view of the stringed electrical musical instrument of FIG. 1 showing the neck section and body section in the disassembled condition;

FIG. 3 is a perspective view of the neck section of FIG. 1 in a 12 string fingerboard configuration with a portion of the fingerboard broken away for convenience of illustration;

FIG. 3A is a fragmentary bottom view of the neck section shown in FIG. 3;

FIG. 4 is a section view taken along the line 4—4 in FIG. 1;

FIG. 5 is a elevation section view taken along the line 5—5 in FIG. 1, showing an interlocking mechanism for detachably mounting the neck section to the body section;

FIG. 6 is an enlarged sectional view taken along the line 6—6 in FIG. 5 showing an adjusting mechanism for slidably adjusting the magnetic pickup and for raising and lowering the latter;

FIG. 7 is a section view taken along the line 7—7 in FIG. 6 showing the magnetic pickup.

DETAILED DESCRIPTION OF THE INVENTION

Referring to the drawings and in particular to FIGS. 1 and 2 thereof, a stringed electrical instrument in the assembled condition indicated generally by the numeral 10 comprises a body section 12 upon which is detachably mounted a neck section designated generally by the numeral 14.

Neck section 14 comprises a conventional head member 16 mounting a plurality of pegs 18 which in turn respectively mount a plurality of strings 20 at one end in suspension over a fingerboard 22. The strings 20 are drawn across frets 24 in contact therewith and over a bridge 26, the ends of the strings 20 being fastened to the base portion 28 of neck section 14 through reinforced holes 30 located in base portion 28 just below bridge 26.

Base portion 28 extends outwardly from the lower end of fingerboard 22 and is of generally rectangular shape. A generally rectangular cut-out 32 substantially in line with fingerboard 22 is provided in base portion 28 to facilitate assembly of neck and body sections 14 and 12, as hereinafter described.

Referring to FIGS. 2 and 5, body section 12 is of conventional overall shape and as a particular feature of the present invention is adapted to receivably mount neck section 14. Thus, body section 12 which is of generally solid construction mounts conventional tone and volume controls 13 and is provided with a recessed main socket 34 formed therein including a narrowed slot 36 extending to the upper end of body section 12. Main socket 34 and extension slot 36 are suitably dimensioned to slidably receive base portion 28 and the immediately adjacent portion of fingerboard 22 so that in the assembled condition of instrument 10 the upper surface of base portion 28 is substantially flush with the upper surface of body section 12 as shown in FIG. 5. In order to enable extension slot 36 to accomodate neck sections of varying number of strings 20 resulting in varying fingerboard widths, fingerboard 22 is undercut along the underside thereof to provide a mount portion 39 of a fixed reduced width to be slidably received in extension slot 36. Base portion 28 terminates at its lower end in a tapered lip 40 extending across the width of the lower edge of base portion 28.

Referring to FIGS. 2 and 5, the lower end 34*a* of socket 34 is formed with an undercut angled keyslot 38 to receive lip 40 in a wedge-like locking engagement to secure the lower end of base portion 28 to body section 12. To complete the securing of base portion 28 to body section 12, the latter is provided with a set-screw 42 threadably mounted in the underside 12*a* and near the upper end of body section 12 and extending through the latter into thru hole 29*a* extending from the underside 12*a* into extension slot 36 and into a threaded hole 296 formed in the underside 28*a* of base portion 28 as shown in FIG. 5. A generally rectangular well 44 is formed in the bottom wall 34*b* of socket 34 and is dimensioned to permit movement therein of magnetic pickup 46 laterally in the direction of the longitudinal axis of fingerboard 22, i.e. direction arrow 48, as shown in FIG. 7 and vertically, i.e. toward and away from the socket bottom wall 34*b* in the direction of arrow 50 as shown in FIGS. 6 and 7.

Referring to FIG. 6, well sidewalls 54 and 56 are undercut at the lower ends thereof adjacent the top surface of the bottom wall 58 of well 44 to form parallel grooves 60 extending the length of well 44. A rectangular recess 62 is formed in the underside of bottom wall 58 extending the length of well 44 and a smooth metal or plastic liner 64 secured thereto by conventional means such as by screws 66. An elongated rectangular through slot 68 is cut through well bottom wall 58 and extends a distance equal to the degree of lateral adjustment of magnetic pickup 46 desired.

The position adjustment assembly 52 for adjusting the lateral and vertical portion of magnetic pickup 46 includes a rectangular slider plate 70 which is slidably received in grooves 60 and adapted to slide on the top surface 58*a* of well bottom wall 58. A central threaded hole 72 formed in slider plate 70 threadably receives set screw 74 which has a knurled head 76 adapted for manual manipulation. Magnetic pickup 46 is fixedly supported by a dished bracket 78 secured to the lower surface 46*a* thereof which is rotably mounted to the upper end of the shank 80 of set screw 74. A threaded winged lock nut 82 is threadably mounted on set screw 74 and positioned between screw head 76 and well liner 64. Screw shank 80 is of suitable length to permit lock nut 82 to be rotated to and from the locked position shown in FIG. 6 and an unlocked position out of clamping engagement with well liner 64. Thus, screw shank 80 threadably engages slider plate 70 and lock nut 82 and extends freely through slot 68 in a direction perpendicular to well bottom wall 58.

In operation, to assemble a particular neck section 14 with the body section 12, the lip 40 of the neck section is tucked into keyslot 38 and the neck base portion 28 is lowered into socket 34 so that the lower portion of fingerboard 22 lies in extension slot 36 and the top surface of base portion 28 is substantially flush with the top surface of body section 12. Set screw 42 is then rotated to engage base portion 28 thereby locking neck section 14 and body section 12 as shown in FIG. 5.

To adjust the lateral or vertical position of magnetic pickup 46, lock nut 82 must first be loosened. The lateral position of magnetic pickup is adjusted by manually moving set screw 74 and thus magnetic pickup 46 along the length of slot 68 to the desired lateral position. The vertical position of magnetic pickup 46 may then be adjusted by rotating set screw 74 until magnetic pickup 46 assumes a vertical position corresponding to the desired tone quality. Lock nut 82 is then rotated until it is clamped against the underside of well bottom wall 58. In this condition, as illustrated in FIG. 6, magnetic pickup 46 is locked against lateral and vertical movement.

While a preferred embodiment of the invention has been shown and described herein, it is obvious that numerous omissions, changes and additions may be made in such embodiments without departing from the spirit and scope of the invention.

What is claimed is:

1. An electric stringed musical instrument comprising: a neck section comprising a fingerboard portion having an integrally connected head member at one end thereof and an integrally connected base portion at the other end thereof, and a plurality of strings having one of their adjacent ends mounted on said head member and extending longitudinally across the length of said fingerboard portion and the other of their adjacent ends mounted on a bridge and secured to said base portion at its end remote from said fingerboard portion, said fingerboard base portion terminating at its lower end in a tapered lip extending across the width thereof, a body section having a recessed socket adapted to receive said base portion of said neck section and a narrowed extension slot extending from said socket; electromagnetic pickup means mounted in said body section socket in operative proximity with a portion of said neck strings intermediate said fingerboard portion and said bridge when said neck section base portion is seated in said body section socket; attachment means for fixedly securing the underside of said neck section to said body section when said neck base portion is seated in said body section socket to form said electric stringed musical instrument in unitary form, said neck section base portion including a generally rectangular cut-out formed therein, said neck strings extending over said cut-out, said cut-out being sized to permit said electromagnetic pickup means to extend therethrough into operative proximity with said neck strings when said neck section base portion is seated in said body section socket, said fingerboard portion being undercut along the underside thereof to form a mount portion of fixed reduced width to be received in said extension slot when said neck section is seated in said body section, said body section socket having an undercut angled keyslot to receive said neck base portion lip in wedge-like locking engagement to secure the lower end of said neck base portion to said body section to permit rapid and secure assembly of said neck and body sections, said body section socket having a depth sized so that when said neck section base portion is seated in said body section socket, the upper surface of said neck section base portion is coplanar with the upper surface of said body section, and adjusting means located on said body section operative to adjust the position of said electromagnetic pickup means linearly vertically through said base portion cut-out in a direction perpendicular to the plane of said strings and linearly horizontally in said body section socket in the direction of the longitudinal axis of said strings.

2. An electric stringed musical instrument as defined in claim 1 wherein said adjusting means is operative to move said electrical means vertically through said base portion cut-out in a direction perpendicular to the plane of said strings.

3. An electric stringed musical instrument as defined in claim 2 wherein said adjusting means includes vertical position locking means for locking the vertical position of said electrical pickup means against movement in a direction perpendicular to the plane of said strings.

4. An electric stringed musical instrument as defined in claim 2 wherein said adjusting means includes horizontal position locking means for locking said electrical pickup means against movement in a direction parallel to the plane of said strings.

5. An electric stringed musical instrument as defined in claim 1 wherein said body section includes electrical tone and volume controls.

6. An electric stringed musical instrument body section for receiving and mounting a removable instrument neck section having a fingerboard portion having a head member at one end and a bridge at the other end for mounting a plurality of strings and a base portion, said fingerboard portion being undercut along the underside thereof to form a mount portion of fixed reduced width, said fingerboard base portion having its base portion terminating at its lower end in a tapered lip extending across the width thereof, said body section comprising: a recessed socket adapted to receive said base portion of said neck section; a narrowed extension slot extending from said socket in the direction of the longitudinal axis of said fingerboard adapted to receive said fingerboard mount portion; said recessed socket having an undercut angled keyslot to receive said neck base portion lip in wedge-like locking engagement to secure the lower end of said neck base portion to said body section to permit rapid and secure assembly of said neck and body sections, electromagnetic pickup means mounted in said body section socket so as to be in operative proximity with a portion of said strings intermediate said fingerboard portion and said bridge when said neck section base portion is seated in said body section socket, said body section socket having an undercut angled keyslot to receive said neck base portion lip in wedge-like locking engagement to secure the lower end of said neck base portion to said body section to permit rapid and secure assembly of said neck and body sections, said body section socket having a depth sized so that when said neck section base portion is seated in said body section socket, the upper surface of said neck section base portion is coplanar with the upper surface of said body section, and adjusting means located on said body section operative to adjust the position of said electromagnetic pickup means linearly vertically through said base portion cut-out in a direction perpendicular to the plane of said strings and linearly horizontally in said body section socket in the direction of the longitudinal axis of said strings.

7. An electric stringed musical instrument neck section for removable mounting in an instrument body section having a recessed socket, an extension slot extending therefrom in the direction of the longitudinal axis of said strings with an undercut angled keyslot, said body section socket having a depth sized so that when said neck section base portion is seated in said body section socket, the upper surface of said neck section base portion is coplanar with the upper surface of said body section and electromagnetic pickup means; said neck section comprising: a fingerboard portion having an integrally connected head member at one end thereof and an integrally connected base portion mounting a bridge at the other end thereof, a plurality of strings having their adjacent ends mounted on said head member and extending longitudinally across the length of said fingerboard portion and the other of their adjacent ends mounted on said bridge and base portion at its end remote from said fingerboard portion; said neck section base portion being adapted to be removably seated in said body section socket, said fingerboard portion being undercut along the underside thereof to form a mount portion of fixed reduced width to be received in said extension slot, said fingerboard base portion terminating at its lower end in a tapered lip extending across the width thereof to be received in said body section angled keyslot in wedge-like locking engagement to receive the lower end of said neck base portion to said body section to permit rapid and secure assembly of said neck and body sections.

8. An electric stringed musical instrument neck section as defined in claim 7 wherein said neck section has a generally rectangular cut-out formed therein with said neck strings extending over said cut-out, said cut-out being sized to permit said electrical pickup means to extend therethrough into operative proximity with said neck strings when said neck section base portion is seated in said body section socket.

* * * * *